United States Patent [19]

Phelps, Sr.

[11] 4,057,854

[45] Nov. 15, 1977

[54] CONVERTIBLE GARMENT

[75] Inventor: John H. Phelps, Sr., Cathlamet, Wash.

[73] Assignees: George King; Peggy King, both of Bellevue, Wash.

[21] Appl. No.: 766,343

[22] Filed: Feb. 7, 1977

[51] Int. Cl.[2] ..... A41B 1/10

[52] U.S. Cl. ..... 2/128; 224/9; 2/105

[58] Field of Search ..... 2/128, 115, 85, 69.5, 2/69, 105; 224/8, 9

[56] References Cited

U.S. PATENT DOCUMENTS

| | | | |
|---|---|---|---|
| 3,633,215 | 1/1972 | Richards | 2/105 |
| 3,698,015 | 10/1972 | Richards | 2/105 |

*Primary Examiner*—Werner H. Schroeder
*Assistant Examiner*—Doris L. Troutman
*Attorney, Agent, or Firm*—Seed, Berry, Vernon & Baynham

[57] ABSTRACT

A sweatshirt or other suitable long-sleeved garment is provided with a drawstring around the neck or the hood, a drawstring through the waist, and grommets in the wrists or cuffs of the sleeves. The sweatshirt can be worn in its customary fashion for warmth. The drawstring in the waist is threadable through the grommets in the wrists to secure the sleeves to the waist and simultaneously close the waist so that it provides a sealed bottom for a pack. The sleeves of the garment can then be worn over the shoulders of the wearer with the drawstring in the neck or hood being available for closing off the top of the pack.

4 Claims, 2 Drawing Figures

CONVERTIBLE GARMENT

BACKGROUND OF THE INVENTION

1. Field of the Invention

This invention pertains to garments which can be converted into backpacks.

2. Description of the Prior Art

There is frequently a need for an emergency backpack when traveling to sporting events, hiking or especially hunting in the forest. In many cases an emergency pack is not available or it is inconvenient to carry the pack when not needed. Accordingly, convertible garments have been known heretofore to convert a shirt, coat, or the like to a pack or sack for these emergencies. U.S. Pat. Nos. 2,959,789 and 1,959,331 are directed to such garments. The aforementioned patented garments, however, are not totally satisfactory. The garments shown in U.S. Pat. No. 2,959,789 is convertible only into a duffle bag which is cumbersome to carry especially when traveling through the woods. The garment shown in U.S. Pat. No. 1,959,331 is more readily useable as a pack but requires the use of a belt not normally found in most garments and has limited storage capacity via a pocket or pouch.

SUMMARY OF THE INVENTION

It is an object of this invention to provide an inexpensive garment readily convertible into a pack.

It is another object of this invention to provide a method for converting a long-sleeved upper body garment into a pack having a large interior storage space.

Basically these objects are obtained by providing a conventional sweatshirt, sweater, with or without a hood, or other long-sleeved upper body garment with waist and neck closures and means for attaching the cuffs of the sleeves to the waist of the garment to form pack shoulder straps. In the method the sleeves are converted to shoulder straps perferably by connecting a drawstring used for closing the waist through grommets in the ends of the sleeves.

The advantages of this convertible garment over those of the prior art are readily apparent. The conversion from sweatshirt or coat is done inexpensively through use of a single drawstring or other suitable closure members such as Velcro fasteners or snaps. The closures are not heavy nor cumbersome when the garment is being worn for its customary purposes. The entire interior body of the garment is usable for storage capacity giving the pack a large capacity. The conversion can be made to any number of inexpensive readily worn garments, especially sweatshirts without substantially increasing the cost or detracting from the appearance of the sweatshirt.

DETAILED DESCRIPTION OF THE PREFERRED EMBODIMENTS

Figure 2:
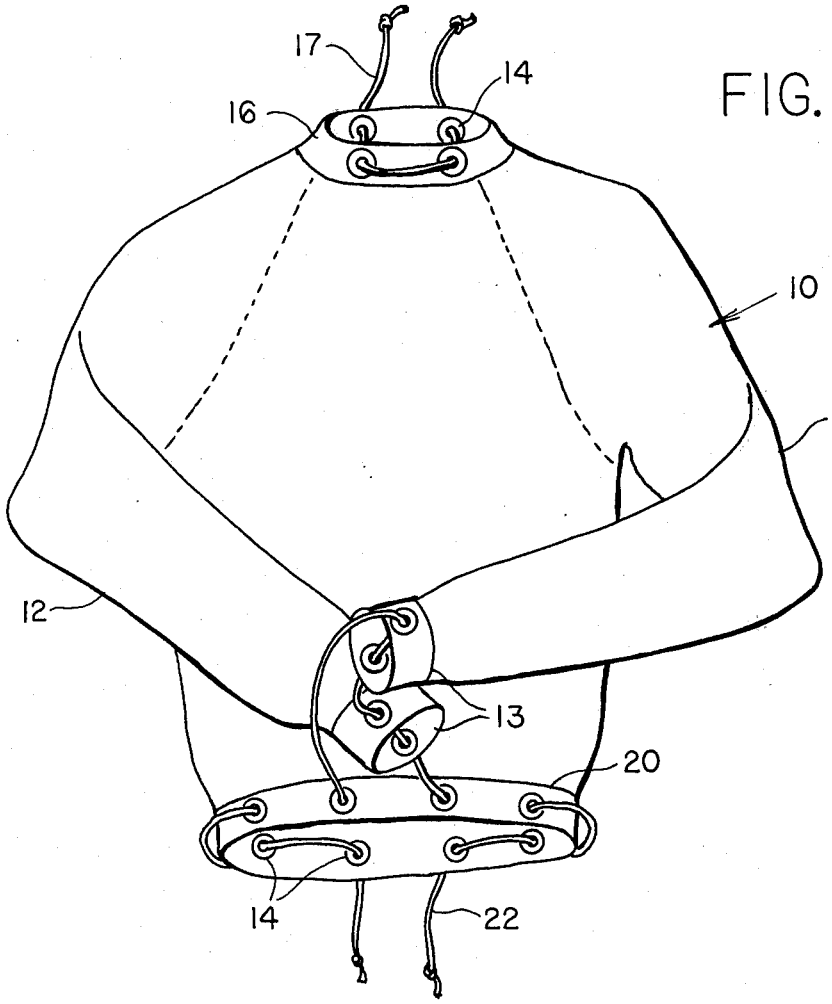
FIG. 2 is a front view of the garment illustrating a preferred technique for converting to a backpack.

As best shown in FIG. 2 the garment such as a sweatshirt 10 is provided with sleeves 12 of the elongated type terminating in wrists or cuffs 13. The wrists 13 are provided with openings surrounded by sets of grommets 14. The upper neck 16 of the garment is provided with a drawstring 17 for closing the neck. As is obvious in the case of a sweatshirt having a hood with a drawstring already provided the hooded drawstring can be used as a closure for the head opening. The garment is also provided with a waist 20 having a drawstring 22 for closing the waist. As above described the sweatshirt is readily usable for wearing for warmth as is conventional practice.

Figure 1:
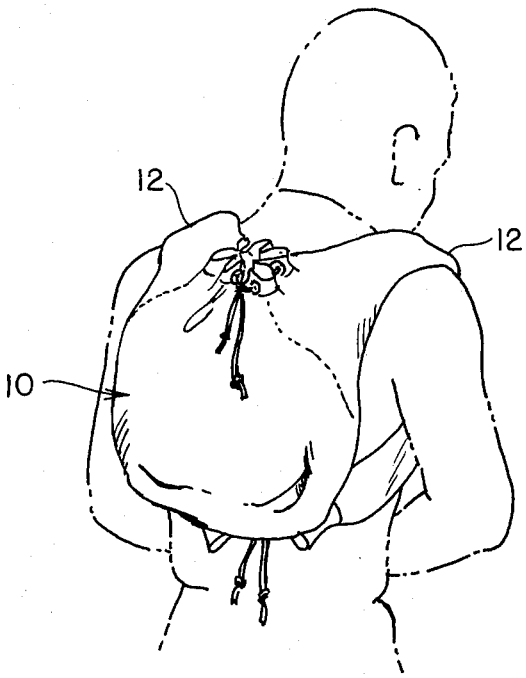
FIG. 1 is an isometric view of the preferred embodiment of the invention which may be converted into a backpack.

As best shown in FIG. 1 the sweatshirt can be converted into a shoulder carried backpack by removing the drawstring 22 and threading it through the pairs of grommets 14 on the cuffs 13 to secure the cuffs of the long sleeves to the body of the garment at the waist. Obviously other means for securing the waist to the cuffs such as through the use of Velcro fasteners, snaps, hooks and eyes and the like are also usable. When the drawstring 22 is tightened to secure the cuffs to the waist, the waist opening is also closed providing a sealed body for the pack. Objects to be placed in the pack such as game, sports equipment and the like are placed through the open neck 16 of the gament and the drawstring 17 may then be tightened to close off the opening. In this fashion the garment now is a pack which is worn by placing the armpits of the sleeves over the shoulders of the carrier in a very confortable backpacking fashion.

While the preferred embodiments of the invention have been illustrated and described, it should be apparent that variations will be apparent to one skilled in the art without departing from the principles herein. Accordingly, the invention is not to be limited to the specific embodiment shown in the drawing.

The embodiments of the invention in which a particular property or privilege is claimed are defined as follows:

1. A garment covertible to a pack comprising:

a garment to be worn on the upper body and having an upper head opening, a waist having a lower opening and a pair of elongated sleeves terminating in wrist ends, first closure means for said head opening, second closure means for said waist lower opening, means for securing said wrist ends of said sleeves to said waist for converting the garment into a wearable pack supported on the shoulders of the wearer with the arms passing between the sleeves and the remainder of the garment, and means for tightening said first and second closure means to provide a closed storage space within the garment when worn as a pack.

2. The convertible garment of claim 1, said second closure means including a drawstring passing around said lower opening, said means for securing said wrist covering openings including grommets through which the drawstring is passed to secure the wrist ends of the sleeves to the waist.

3. A method of converting a garment having a waist, a neck, and elongated sleeves terminating in wrist ends to a pack comprising:

closing the waist of the garment, securing the wrists of the sleeves to the waist to convert the sleeves into pack-carrying shoulder straps, and closing the neck whereby the interior of the garment is used for carrying objects.

4. The method of claim 3, said step of securing the wrists to the waist including passing a drawstring through the waist, tightening the drawstring to close the waist and securing the drawstring to the wrists of the sleeves.

* * * * *